US005509480A

United States Patent [19]

Terrell et al.

[11] Patent Number: 5,509,480

[45] Date of Patent: *Apr. 23, 1996

[54] CHEMICAL CUTTER AND METHOD FOR HIGH TEMPERATURE TUBULAR GOODS

[76] Inventors: Jamie B. Terrell; Donna K. Terrell, both of 1916 Christopher Dr., Ft. Worth, Tex. 76140

[ * ] Notice: The term of this patent shall not extend beyond the expiration date of Pat. No. 5,320,174.

[21] Appl. No.: 259,255

[22] Filed: Jun. 13, 1994

Related U.S. Application Data

[63] Continuation-in-part of Ser. No. 899,632, Jun. 16, 1992, Pat. No. 5,320,174.

[51] Int. Cl.[6] ..... E21B 29/02

[52] U.S. Cl. ..... 166/297; 102/275.11; 149/108.2; 166/55

[58] Field of Search ..... 166/55, 55.2, 297, 166/298; 149/108.2; 264/3.1, 3.4; 102/275.11, 202.14

[56] References Cited

U.S. PATENT DOCUMENTS

| | | | |
|---|---|---|---|
| 2,918,125 | 12/1959 | Sweetman | 166/297 |
| 3,066,058 | 11/1962 | Gall | 149/108.2 X |
| 3,076,507 | 2/1963 | Sweetman | 166/297 |
| 4,125,161 | 11/1978 | Chammas | 166/297 |
| 4,446,920 | 5/1984 | Woytek et al. | 149/108.2 X |
| 4,494,601 | 1/1985 | Pratt et al. | 166/212 |
| 4,619,318 | 10/1986 | Terrell et al. | 166/55 |
| 5,287,920 | 2/1994 | Terrell | 166/55 |

*Primary Examiner*—David J. Bagnell

*Attorney, Agent, or Firm*—William D. Jackson; Harris, Tucker & Hardin

[57] ABSTRACT

Chemical cutting processes and tools for use in a well bore useful in the cutting of high strength and corrosion-resistant downhole tubular goods. The cutting tool has an elongated tool body comprising a chemical section and a cutting section having a plurality of cutting ports therein. After lowering the cutting tool to the desired location within the well, the cutting agent is discharged from the chemical section into contact with an ignitor material formed of a permeable mixture of metallic ignitor component and a promoter component which can be a metallic component or a grease component or both. The promoter component is formed of a material which is exothermically reactive with the cutting agent at a first temperature and the ignitor component is exothermically reactive at a higher temperature. The ignitor component may be formed of a predominately or entirely non-ferrous corrosion-resistant metal alloy. The pre-ignited chemical cutting agent is dispensed from the cutting tool in a plurality of jet streams emanating from the cutting ports in the cutting section of the tool and into contact with the inner surface of the tubular member to effect a cut therein.

28 Claims, 10 Drawing Sheets

CHEMICAL CUTTER AND METHOD FOR HIGH TEMPERATURE TUBULAR GOODS

This application is a continuation-in-part of application Ser. No. 899,632 filed Jun. 16, 1992, now U.S. Pat. No. 5,320,174.

TECHNICAL FIELD

This invention relates to systems and processes for the cutting of downhole tubular goods and more particularly to such processes and systems which can be used to form cuts in high strength, high temperature alloy tubular goods.

BACKGROUND OF THE INVENTION

There are many circumstances in the oil industry where it is desirable to cut into or through downhole tubular goods within a well. For example, in the course of drilling a well, the drill pipe may become stuck at a downhole location. This may result from "keyseating" or as a result of cuttings which settle within the well around the lower portion of the drill string. In order to remove the drill string from the well, it may be necessary to sever the drill pipe at a location above the stuck point. Similarly, it is often necessary to carry out downhole cutting operations during the completion or operation or abandonment of oil or gas wells. For example, it is sometimes desirable to sever casing or tubing at a downhole location in order to make repairs or withdraw the tubular goods from a well which is being abandoned or repaired. In most cases, the pipe is reusable. In other circumstances, it is desirable to cut slots, grooves or perforations in downhole tubular goods. Thus, it is a common expedient to perforate the casing and surrounding cement sheath of a well in order to provide fluid access to a hydrocarbon bearing formation. Similarly, it is sometimes desirable to perforate tubing in the completion or recompletion of a well.

Chemical cutters can be used to significant advantage in the application of chemicals to cut, sever or perforate downhole tubular goods. For example, U.S. Pat. No. 2,918,125 to Sweetman discloses a downhole chemical cutter which employs cutting fluids that react violently with the object to be cut with the generation of extremely high temperatures sufficient to melt, cut or bum the object. In the Sweetman procedure, halogen fluorides are employed in jet streams impinging on the downhole pipe to sever or perforate the pipe. The attendant reaction is highly exothermic and the pipe is readily penetrated. Examples of chemical cutting agents disclosed in Sweetman are fluorine and the halogen fluorides including such compounds as chlorine trifluoride, chlorine monofluoride, bromine trifluoride, bromine pentafluoride, iodine pentafluoride and iodine heptafluoride. The cutting fluid is expelled from the tool through radial ports in jet cutting streams. In Sweetman, the cutting ports extend radially from a central bore within the discharge head of the cutting tool which terminates in a reduced diameter bore which is open to the lower or front end of the cutting tool. The reduced diameter bore is internally threaded to receive a threaded plug which closes the lower end of the bore.

As further disclosed in U.S. Pat. No. 4,619,318 to Terrell et at., objects may be perforated or in some instances, completely dissolved with no debris left in the well through the use of a downhole chemical cutter. As disclosed in this patent, the chemical cutting tool may be provided with a downwardly extended nozzle provided with a suitable stand-Off sleeve. In addition to the halogen fluoride cutting agents as disclosed in the aforementioned patent to Sweetman, further cutting agents as disclosed in the Terrell et at. patent include nitrogen fluoride sources Other than the particular adaptation of a nozzle configuration as described in the aforementioned Terrell et al. patent, the normal practice in severing downhole tubular goods is to arrange the cutting ports which are located on the circumference of the cutting head radially and perpendicular to the centerline of the tool, defining a disk-like planar pattern. Thus, in U.S. Pat. No. 3,076,507 to Sweetman, a cutting head is disclosed in which a plurality of jet passages of restricted diameter extend radially through the wall of the cutting head body in a single plane perpendicular to the vertical centerline of the head. A similar configuration is disclosed in U.S. Pat. No. 4,125,161 to Chammas. Here, the cutting head is a cylindrical member provided with a plurality of discharge ports arranged radially about the outer diameter of the head through which the chemical cutting agent issues in a plane generally perpendicular to the vertical centerline of the head. The cutting ports are bridged with a piston provided with o-rings to prevent the entry of fluids through the ports. A lower portion of the tool is provided with openings through which well fluid exerts hydrostatic pressure on the bottom of the piston, holding the piston in place before the tool is fired.

Yet another chemical cutting tool is disclosed in U.S. Pat. No. 4,494,601 to Pratt et al. Here, a lower part of the cutting head structure is open to well fluid and a piston plug is interposed immediately above the cutting ports. The cutting ports may be closed to the exterior of the well by means of an internal sleeve positioned in the bore of the cutting head immediately in front of the piston. As in the cutting tools described above, the cutting ports lie in a single plane perpendicular to the centerline of the tool.

The aforementioned U.S. Pat. No. 5,320,174 discloses a chemical cutting tool incorporating a cutting head assembly for use in cutting high strength and corrosion resistant tubular goods such high chrome-nickel stainless steel. This cutting tool comprises a chemical section adapted to contain chemical cutting agent and a cutting section adapted receive the chemical cutting agent from the chemical section. The cutting section has a plurality of cutting ports which are arranged in first and second groups. The first and second groups of cutting ports have generally conforming pattern and are in a canted relationship with respect to one another. At least some of the cutting ports in one group are in a staggered relationship longitudinally along the tool body relative to cutting ports in the other group. In one embodiment of this cutting tool, the ports are arranged circumferentially of the tool body and provide first and second planar patterns in a converging relationship such that they intersect their locus externally of the tool body. Alternatively, the cutting ports are arranged in first and second ring-shaped configurations defining an annular relationship with the cutting ports on the inner ring configuration being on a different radii than those on the outer ring configuration.

An accumulation of ignitor material is interposed between the chemical section and the chemical ports such that when the tool is activated to dispense the chemical cutting agent, it traverses the ignitor material. The ignitor material is formed of a permeable accumulation of first and second metal components, such steel wool or other similar metal having a intermeshing fillamentry structure and chips, powders or shavings from high melting point metal such chromium, nickel, titalium and titanium. The steel wool can be mixed with oil or another hydrocarbon. The ignitor hair can also be formulated of predominately non-ferrous material.

For example, the stainless steel shavings or other non-ferrous powders, chips or filings can be mixed with oil or other similar organic material.

Yet another chemical cutting tool which is useful in cutting large diameter tubular goods within a well is disclosed in U.S. Pat. No. 5,287,920 to Terrell. This chemical cutting tool is effective in large diameter conduits having a diameter of about 8 inches to one foot or even larger. In this tool, the cutting section has a plurality of externally upset cutting heads which extend outwardly from the cutting section. Each of these externally upset cutting heads has a plurality of cutting ports. Here, ignitor material may be located in a central conduit interposed between the chemical section and the cutting section similarly as in the cutting head of U.S. Pat. No. 5,320,174 or alternatively, the ignitor material may be located in bores within each of the upset cutting heads or spokes as described in U.S. Pat. No. 5,287,920.

SUMMARY OF THE INVENTION

In accordance with the present invention there are provided a new chemical cutting processes and tools incorporating a cutting head assembly which are particularly useful in the cutting of high strength and corrosion-resistant tubular goods such as high chrome-nickel stainless steel. In one aspect of the invention there is provided a method of cutting tubular well goods at a downhole location within a well extending into the earth from a well head. In carrying out the invention, a chemical cutting tool is inserted into the well and into the interior of the tubular member to be cut. The cutting tool has a chemical section that contains a cutting agent that interacts with the tubular member to form a cut therein and further comprises a cutting section adapted to receive the chemical cutting agent from the chemical section. After lowering the chemical tool to the desired location within the tubular member at which the cut is made, the cutting agent is discharged from the chemical section into contact with an ignitor material to effect an exothermic prereaction of the cutting agent. The ignitor material is formed of a permeable mixture of metallic ignitor component and a promoter component which can be a metallic component or a hydrocarbonaceous grease component or which may contain both such components. The promoter component is formed of a material which is reactive with the cutting agent in an exothermic reaction at a first temperature and the ignitor component is reacted with the cutting agent in an exothermic reaction at a second higher temperature. In a specific embodiment of the invention, the ignitor component is formed of a predominately non-ferrous corrosion-resistant metal alloy. The pre-ignited chemical cutting agent is dispensed from the cutting tool in a plurality of jet streams emanating from cutting ports in the cutting section of the tool and into contact with the inner surface of the tubular member to effect a cut therein. Preferably, the cutting agent is dispensed from first and second groups of cutting ports. The first group of ports are arranged in a configuration conforming in the desired shape of the cut in the tubular member and define a first planar pattern. The second group of cutting ports are arranged in a second planar pattern. The second pattern generally conforms to the first pattern and is in a canted relationship with the second pattern.

In one embodiment of the invention, the ignitor material is provided in a mass of material having an internal passageway extending between the chemical section and the cutting ports to facilitate fluid flow from the cutting section to the cutting ports. The ignitor component preferably has a melting temperature in excess of 1600° C. and the promoter component is in intimate contact with the ignitor component to facilitate the reaction of the ignitor component and the cutting agent. In a preferred aspect of the invention, the promoter component is selected from the group consiting of a hydrocarbonaceous grease or steel wool or, more preferably, mixtures thereof. The ignitor component comprises a metal containing chromium in an amount of at least 10 wt. % and may take the form of substantially pure chromium. The ignitor component preferably is formulated in a plurality of elongated cuttings or shavings. The hydrocarbonaceous grease may be interposed throughout the ignitor mass and the ignitor mass preferably comprises a plurality of transverse layers of the ignitor component which comprises both grease and steel wool or other easily ignitable metal and the ignitor component.

In one embodiment of the invention, the cutting ports in the elongated tool body are arranged circumferentially of the tool body to provide first and second planar patterns, generally normal to the major axis of the tool body. The planar patterns are in a converging relationship such that they intersect at a locus externally of the tool body.

A similar principle is applied in an embodiment of the invention adapted to cut relatively large perforations in downhole tubular goods. Here, the cutting ports lie in first and second ring-shaped configurations in an annular relationship with one another. The cutting ports within the inner ring configuration are on different radii than the cutting ports in the outer ring configuration, again providing for an increased metal volume around the cutting ports.

In yet another embodiment of the invention for use in large head type cutting tools such as the type disclosed in the aforementioned U.S. Pat. No. 5,287,920, the cutting section has a plurality of upset cutting heads which extend outwardly from the cutting section along circumferentially spaced transverse axis to a point where they terminate in an outer cutting surface having a desired effective diameter.

Here, a multi-component ignitor material formulated in accordance with present invention may be located in the bores of the externally upset cutting heads or it may be located in a common central bore leading to the plurality of upset cutting heads or component parts may be disposed in both locations.

DESCRIPTION OF THE PREFERRED EMBODIMENTS

The present invention provides a chemical cutting tool which can be effectively used in cutting, severing or perforating downhole tubular members formed of metal alloys which are extremely tough and difficult to cut while at the same time, providing a tool having an extended effective life. This is accomplished in the present invention through the use of cutting heads having the cutting ports therein arranged in novel configurations and further, through the use of multi-component pre-ignition materials which are particularly effective for use in chemical cutting tools embodying such cutting heads.

A weak link that may limit the life of a chemical cutter head is due to the cutting ports of the head. Characteristically, for prior art chemical cutter heads, the least amount of metal in the head will be found in the perpendicular plane that passes through the longitudinal center of these cutting ports. The present invention provides chemical cutting heads having cutting port configurations which enable the cross-sectional areas of the metal in this critical area to increase by a factor of almost three. In one embodiment of the invention, this is accomplished by alternately placing each second port, one diameter hole (or more) above the first port and the third port, one diameter hole below the first port of each group of three ports. This pattern is completed around the total circumference of the head. The second and third holes of each group are placed in tilted frustoconical planes in which the exit jets converge in a common frustoconical plane at the interior of the wall of the pipe to be cut. In addition to added strength, a superior heat transfer in the critical region is accomplished. The life of a cutting head is usually determined by the integrity of the port holes. Typically, after a few cuts (occasionally only one cut in mud or weighting fluids such as calcium chloride or calcium bromide), the holes become too enlarged to form evenly spaced jets around the circumference of the head. Also, the jets from these enlarged port holes are too large in diameter to impinge the interior of the pipe with sufficient velocity to initiate the chemical reaction between the hot fluorine and the metal of the pipe. For most applications, the diameter of each port hole will be between 0.053 inch and 0.093 inch in diameter. The increased volume of metal around the port holes provides for enhanced heat dissipation in the head and more heat flow from the port holes is accomplished.

Figure 1:
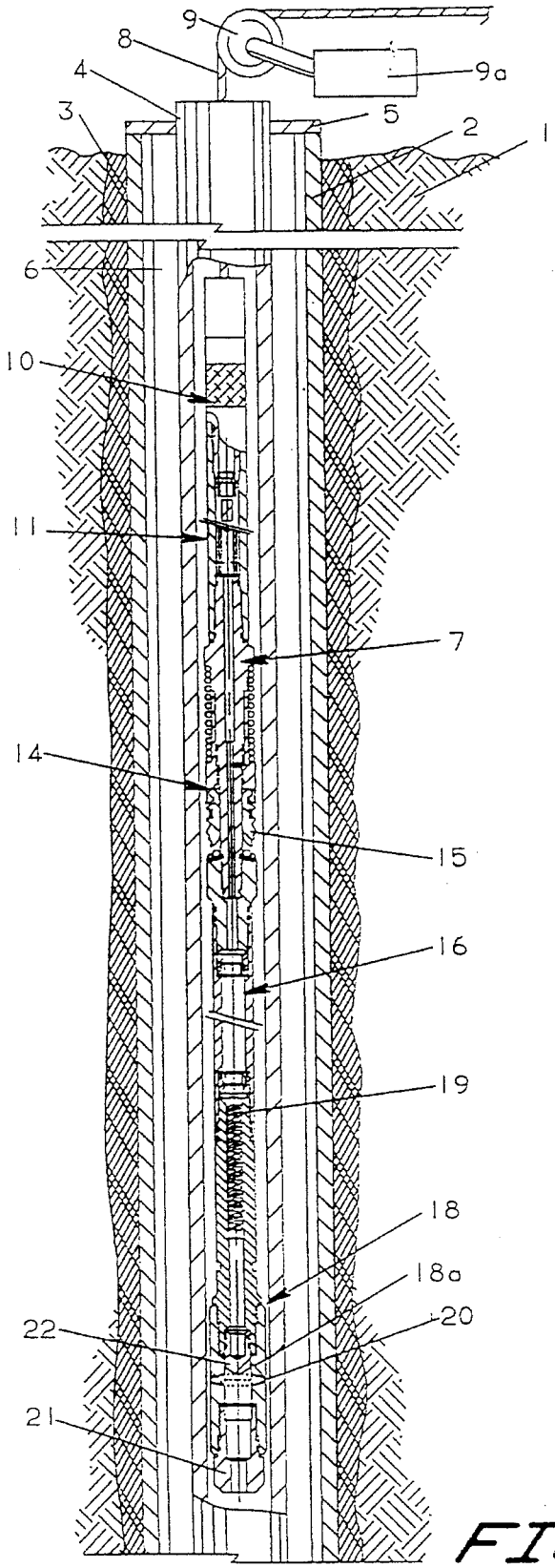
FIG. 1 is an illustration, partly in section, showing a downhole chemical cutter located in a well.

For a further description of the present invention, reference will be made to the drawings with regard to which the invention will be described in detail. As shown in FIG. 1 of the drawings, there is illustrated a chemical cutting tool embodying the present invention disposed within a well extending from the surface of the earth to a suitable subterranean location, e.g., an oil and/or gas producing formation (not shown). More particularly, and as is illustrated in FIG. 1, a well bore 1 is provided with a casing string 2 which is cemented in place by means of a surrounding cement sheath 3. A production tubing sting 4 is disposed in the well as illustrated and extends from the well head 5 to a suitable downhole location. The tubing sting and/or the annular space 6 between the tubing and the casing may be filled with high pressure gas and/or a liquid such as oil or water. Alternatively, the tubing string 4 or the annulus 6 may be "empty", i.e., substantially at atmospheric pressure.

As described below, the tubing or other tubular metal to be cut is formed of a corrosionresistant high-strength metal alloy of the type which is often used in relatively deep oil and gas wells where high temperature corrosive conditions are encountered. As will be recognized by those skilled in the art, corrosion problems are exacerbated by the presence of high temperatures, e.g. 140° C. or more, and by corrosive fluids often encountered in deep wells. Corrosion at these high temperatures may be caused by water, but even more serious corrosive conditions are caused by the presence of acid gases, such as hydrogen sulfide and carbon dioxide often found in so-called "sour gas" wells. Typically, such wells may be in depths from 10,000 to 20,000 feet or more, with temperatures ranging from about 150° C. up to 200° C. Typically, such corrosion-resistant tubular goods are formed from so-called "alloy steels" containing chromium and nickel in addition to iron. The chromium content of such steels typically ranges from about 10 to 30 wt. %. The nickel content may be less than that of the chromium, e.g. down to about 5 wt. % or may be substantially higher than the chromium content, ranging up to as much as 50 wt. %. Typically, stainless steel alloys can be characterized in three groups: 1) austenitic, which contains both chromium and nickel as well as a small amount of silicon, 2) ferritic steel, which contains chromium without the presence of nickel and 3) martensitic, which may or may not contain nickel.

The downhole tubular goods may also be formed of so-called SAE alloy steels which may contain manganese, molybdenum (normally together with chromium as in so-called "chromemoly" steels), chromium and nickel (so-called "nickel-moly" steels), vanadium, nickel (usually with chromium as described above or with molybdenum), and mixtures of nickel, chromium and molybdenum which may contain small mounts of boron. Many of the SAE steels may also contain small amounts of silicon. Another group of corrosion-resistant metals which are sometimes used in forming downhole tubular goods are the so-called "monel" metals which are alloys formed predominately of nickel and copper with small amounts of manganese and iron together with small percentages of carbon, sulfur and silicon. Some monel alloys may also contain small amounts of aluminum, titanium and cobalt.

These various corrosion-resistant metal alloys all have in common the characteristic of being difficult to cut with the chemical cutting agents normally used in downhole cutting operations as described above. The various corrosion-resistant metals as described above are difficult to cut for various reasons. The stainless steels, chrome-moly steels, nickel-moly steels and the like are difficult to cut because of their relatively high melting temperatures which are in excess of the melting point of conventional steel which melts at about 1500°–1600° C. The various stainless steel materials, primarily because of their chromium content, melt at higher temperatures in excess of 1600° C., ranging up to about 1700°–1900° C. or more. The monel materials actually have lower melting points than conventional steel tubular goods but are difficult to cut because they are highly conductive due primarily to their copper content. Thus, they rapidly conduct heat away from the cutting sight making cutting operations difficult.

As further illustrated in FIG. 1, a chemical cutting tool 7 is suspended from a cable (wireline) 8. The cable 8 passes over suitable indicating means such as a measuring sheave 9 to a suitable support and pulley system. The measuring sheave produces a depth signal which is applied to an indicator 9*a* which gives a readout of the depth at which the tool is located. It will, of course, be recognized that the well structure illustrated is exemplary only and that the cutting tool 7 can be employed in numerous other environments. For example, instead of a completed well, the tool can be employed in severing a drill pipe in either a cased or uncased well. In this case, the tubing string 4 shown would be replaced by a string of drill The chemical cutter 7 is composed of five sections. At the upper end of the tool there is provided a fuse assembly 10 comprised of a fuse sub and an electrically activated fuse (not shown). Immediately below the fuse assembly 10 is a propellant section 11 which provides a source of high pressure gas. For example, the propellant section 11 may take the form of a chamber containing a propellant, such as gun powder pellets, which burns to produce the propellant gases. Immediately below the propellant section 11 is a slip section 14 incorporating a slip array 15 that anchors the tool during the cutting cycle. A chemical module section 16 is located below the slip section 14. This section contains a suitable chemical cutting agent. Preferably, the chemical cutting agent will take the form of a halogen fluoride, more preferably, bromine trifluoride. Immediately below the chemical module section 16 is a head assembly 18. This section contains a high temperature ignitor material 19 such as steel wool or grease, preferably a mixture of steel wool and grease and chromium, stainless steel or other alloy shavings as described below, which activates the halogen fluoride, bringing it to a temperature that will quickly cut the tubing 4. The head assembly 18 also contains cutting ports 20 through which the fluid is directed against the interior wall of the tubing string 4. In the embodiment shown, the head section is equipped with the ports 20 extending about the periphery thereof to completely sever the tubing string 4 in the well. The port holes are arranged in a plurality of converging planar patterns generally normal to the major axis of the tool body. This arrangement greatly facilitates the severing of hard-to-cut high temperature alloy materials as described below.

The ignitor mass as described previously, is formulated of a mixture of materials comprising at least two components characterized as an ignitor component and a promoter component. The ignitor component reacts with the cutting fluid in an exothermic reaction bringing the cutting fluid temperature to a sufficiently high level to effectively cut through the tubing. The promoter component reacts with the cutting fluid in an exothermic reaction to facilitate the reaction of the ignitor component and the chemical cutting agent.

The promoter component described above, can take the form of a hydrocarbonaceous grease or a fine fillamentary material such as steel wool and preferably takes a form comprising both of these two sub-components. The ignitor component can take the form of the shavings or cuttings which can be formulated of the alloy materials from which the tubing to be cut is formed. Thus, the ignitor component can take the form of the various corrosion resistant metal alloys of the type described above. In most cases, the corrosion-resistant tubing will be formed of chromium and the ignitor component can likewise comprise chromium. The chromium normally should be present in the amount of at least 10 wt. % of the alloy or if desired, substantially pure chromium can be used. Chromium-nickel and chromium-nickel alloys can also be used. The materials which can be used to formulate the ignitor component also include tungsten, molybdenum, vanadium and alloys these materials.

Figure 2:
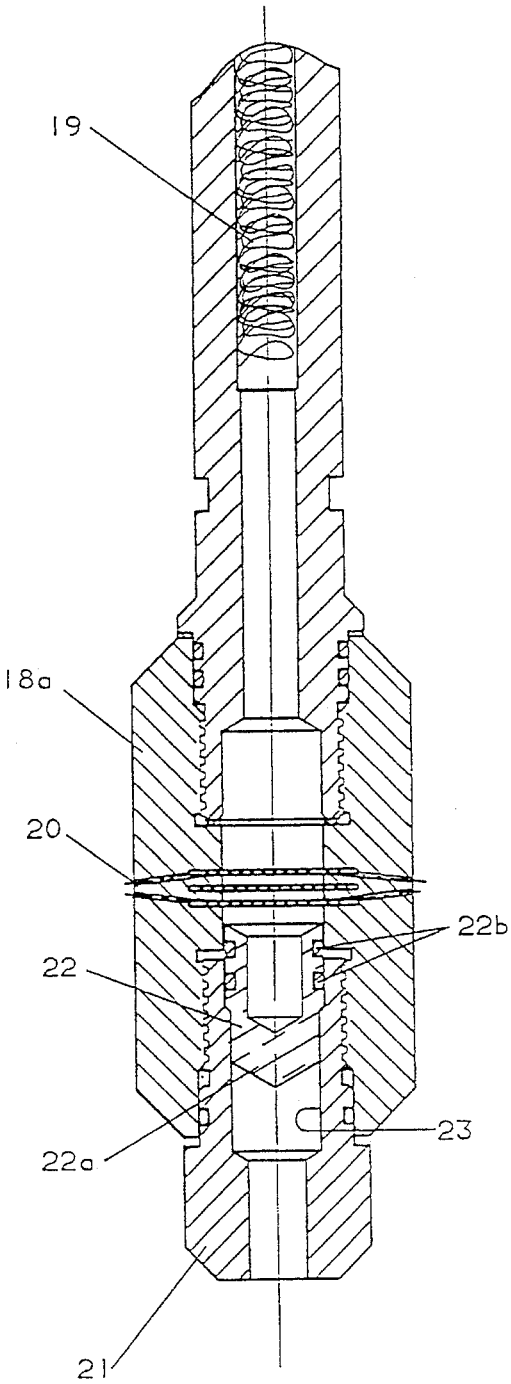
FIG. 2 is a sectional elevational view of a portion of the chemical cutter illustrating the arrangement of cutting ports in the cutting head in accordance with one embodiment of the present invention.

The head assembly 18 includes a bull nose sub 21 which is threadedly secured into a cutting head 18*a* containing the ports 20 and which is open at its lower end to provide a continuation of the central bore extending through the head assembly which is open to the well bore. A piston plug 22 is disposed in the central bore of the cutting head immediately above the level of the cutting ports 20. As described below, the piston plug is driven downwardly to a position below the cutting ports, as shown in FIG. 2 described hereinafter, and is wedged into slightly reduced diameter section of the bore as described in greater detail in the aforementioned U.S. Pat. No. 4,494,601 to Pratt and Terrell.

Preferably, the ignitor mass 19 has an elongated internal passageway 19*a* extending between the chemical section 16 and the cutting head assembly 18. The passageway 19*a* facilitates the flow of fluid through the mass and into intimate contact with the promoter and ignitor materials to facilitate the pre-ignition sequence. The central passageway or borehole 19*a* can be easily formed during the fabrication of the ignitor mass by simply wrapping the ignitor and promoter material around a tubular rod of an appropriate diameter. For example, a ⅛" steel rod can be used. A thin layer of steel wool, perhaps, ⅛" thick, can be laid out flat, followed by about ¼" chromium cuttings and shavings piled on the steel wool. A thin layer of grease is then spread over the chromium shavings. This material can then be wrapped around the steel rod in a configuration in which the grease is initially next to the rod and the steel wool is on the outside. Several wraps are made so as to provide a plurality of transverse layers of the ignitor and promoter components. The steel rod, an hence the passageway 19*a*, can typically range from a value of about ⅛" in tools used for curing of very small diameter tubings such as those having 2⅜" diameter ranging to ¼" or even larger in tools designated for cutting bigger tubing such as 4½",5½" or 7" inch diameter tubings.

The operation of the chemical cutter tool 7 may be described briefly as follows. The tool is run into the well on the wireline 8 to the desired depth at which the cut is to be made. An electric signal is then sent via wireline 8 to the chemical cutter tool 7 where it sets off the fuse, in turn igniting the propellant. As the propellant bums, a high pressure gas is generated and travels downward through the slip section 14 and forces the slip array 15 outwardly in a manner described hereinafter. The slip array 15 thus anchors the chemical cutter tool 7 in the tubing string 4. As the gas pressure further increases, seal diaphragms within the chemical module section 14 are ruptured and the halogen fluoride or other cutting agent is forced through the ignitor hair 19 which ignites the chemical. The gas pressure then forces the activated chemical cutting agent into the head section 18 and ultimately outwardly through cutting ports 20. In a short period of time, normally less than a second, the tubing 4 is severed and the slip array 15 is retracted so that the chemical cutter tool 7 can then be withdrawn from the tubing string 4. For a further description of the general operating conditions and parameters employed in the chemical cutter tool 7, reference may be made to the aforementioned U.S. Pat. Nos. 4,494,601 and 4,345,646 to Terrell and 4,415,029 and 4,619,318 to Pratt and Terrell, the entire disclosures of which are incorporated herein by reference.

FIG. 2 illustrates a preferred embodiment of the invention in which the cutting ports are arranged in three planar patterns, identified below as planes A, B and C, which are in a converging relationship. The patterns converge such that they intersect at a location within the wall of the tubing string or other tubular member to be cut, as described in greater detail below with respect to FIG. 4. In FIG. 2, the preferred embodiment of this invention, the head assembly including the cutting head 18*a* is shown in detail after the tool has been fired and the head piston 22 has been wedged by cutting fluid pressure into the bull nose 21 as the cutting cycle is initiated.

As shown in FIG. 2, the lower portion of the bore 23 within the bull nose sub is slightly reduced with respect to the upper portion of the bore within which the piston plug is more readily slidable. In addition, the lower portion 22*a* of the piston plug is reduced slightly with respect to the upper potion of the piston carrying o-rings 22*b* to an outer diameter slightly larger than the diameter of reduced section 23. As a result, upon firing the tool, the piston plug is securely wedged into the lower portion of the bull nose sub 21, where it remains after the cutting action is completed and the tool withdrawn.

Figure 3:
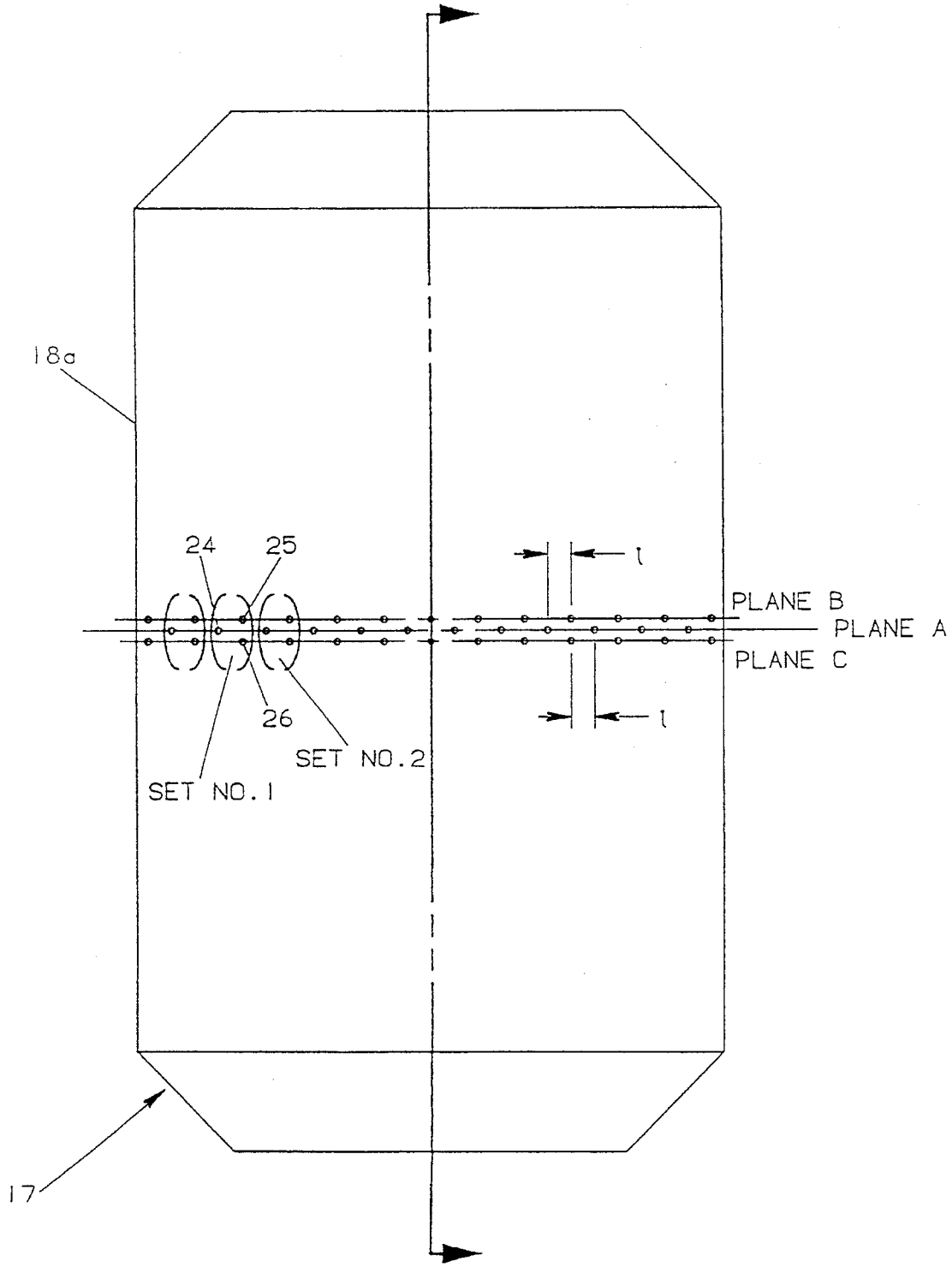
FIG. 3 is a side elevation of the cutting head shown in FIG. 2 illustrating the pattern of cutting ports arranged in sets in accordance with the present invention.
Figure 4:
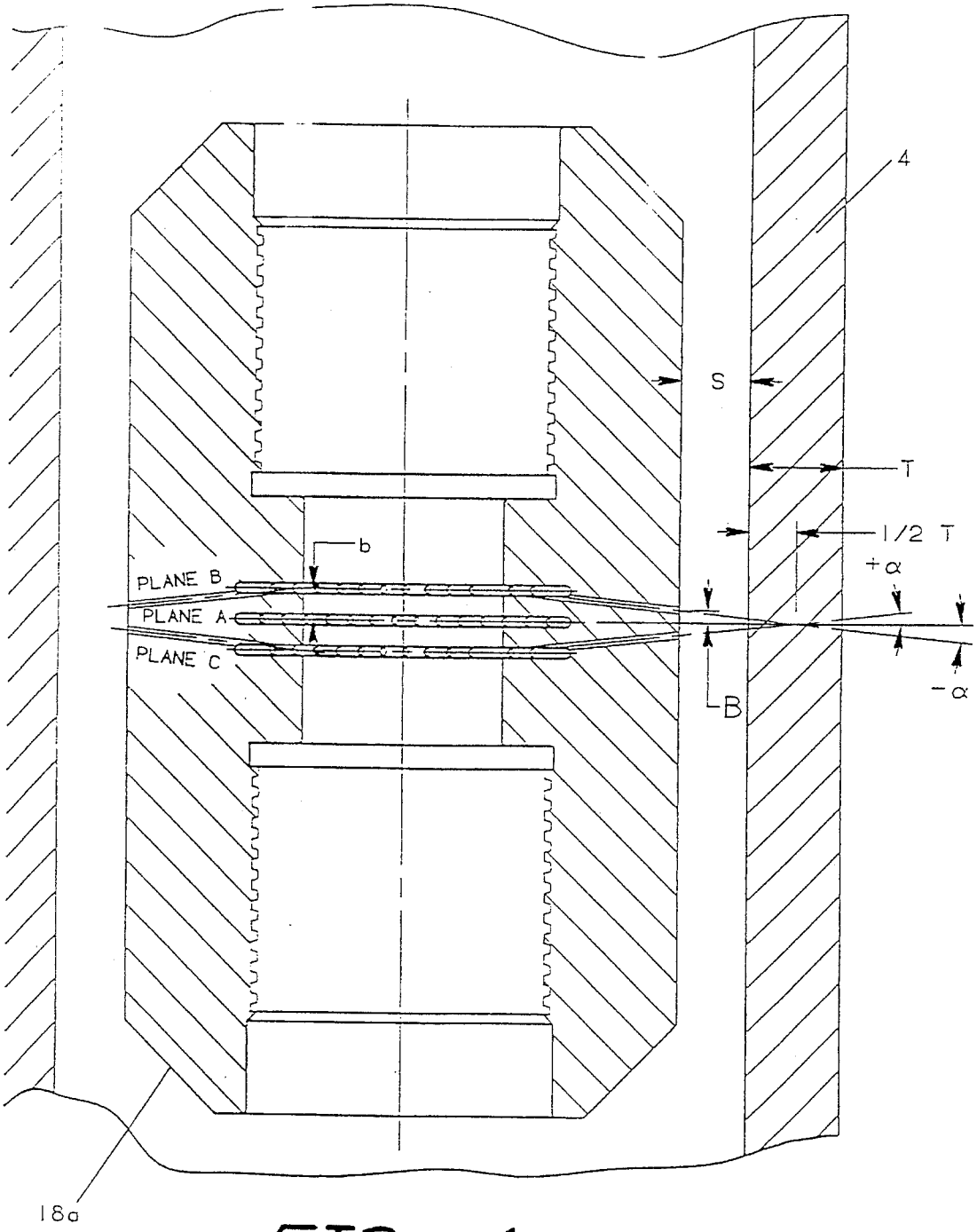
FIG. 4 is a sectional view of the cutting head of FIG. 3 taken along the lines 3—3 and further showing the cutting head within the tubular member to be cut.

A preferred orientation of the cutting ports for planes A, B, and C is shown in FIG. 3. FIG. 3 illustrates the port holes as drilled in sets of three each. For example, the first port hole 24 in set no. 1 is placed in a perpendicular plane A with respect to the vertical centerline of the head 18*a*. The second port hole 25 is located in frustoconical plane B which is tilted with respect to plane A so that the two planes converge. The third port 26 is located in a frustoconical plane C (which is also tilted relative to plane A). As shown in FIG. 4, the angle of tilt of frustoconical plane B is such that the jet of cutting fluid from port hole 25 will meet at the intersection of plane A and frustoconical plane B at the desired distance of one-half the wail thickness of pipe 4 that is being severed, as explained in greater detail below. Likewise, the angle of tilt of frustoconic plane C is such that the jet of cutting fluid from port 26 will meet at the intersection of perpendicular plane A and frustoconical plane C at the desired distance of one-half T of pipe that is being severed. As shown in FIGS. 3 and 4, perpendicular plane A, frustoconical planes B and C preferably are separated at one outer surface of the head 18*a* by at least one diameter of a port hole. The distance B of FIG. 4 is the distance from the center of one port hole of a tilted frustoconical plane (C or B) to the center of a port hole in the perpendicular plane A, as measured vertically on the outside cylindrical surface of head 18*a*. The remaining sets of port holes are drilled in like manner around the circumference of head 18*a*. In FIG. 4 the wall thickness of the pipe 4 is designated as T. The nominal distance that the head 18*a* is located from the interior surface of the pipe during the cutting cycle is designated as S and preferably is about 0.2 inches. It has been found that the location of the convergence point of the cutting jets is most effective if this convergence occurs at a point one-half the wall thickness of the pipe being cut. This convergence point then determines the tilt angle of frustoconical planes B and C with respect to perpendicular plane A.

Referring again to head 18*a*, as shown in FIG. 4, the arrangement of the cutting ports can be illustrated by the following example. Assuming the outside diameter of the pipe 4 to be cut is 5.5 inches with a wall thickness T of 0.313 inches, the internal diameter of the pipe is 4.874 inches. If the outside diameter of head 18*a* is 4.5 inches, the distance S may be calculated as one-half of the difference between the outer head diameter and the pipe internal diameter, i.e., 0.187 inches. The cutting ports have diameters of 0.055 inch.

The value of S is referred to as the standoff value of the cut. The angle $\propto$ of each frustoconical plane B or C with respect to perpendicular plane A is determined by the following equation:

$$\tan \propto = B/(0.5 \text{ Pipe ID} - \text{Head O.D.}).$$

wherein B as previously explained is 0.55 inches and which is the distance between planes B or C and A at the outer surface of head 18*a*, and S and T are as defined above. For this example:

$$\tan \propto = (0.055/0.5\ (4{,}874 - 4.5) + 5\ (0.313)$$

$$\tan \propto = 0.16$$

$$\propto = 9.1°$$

Therefore, frustoconical plane B is inclined at an angle of −9.1 degrees with respect to perpendicular plane A and frustoconical plane C is inclined at an angle of +9.10 degrees with respect to perpendicular plane A.

The number of cutting ports in each frustoconical plane and the circumferential spacing of these holes may be determined as follows. Empirical considerations indicate that a cutting head of approximately 4.5 inches in outside diameter should have about 75 cutting ports. Therefore, assuming an equal number of cutting ports in each plane, perpendicular plane A and each tilted frustoconical plane B and C of FIG. 4 will contain 25 port holes. The planar centerline spacing (or circumferential separation distance) i of the holes around the outside diameter of the head 18*a* is determined as follows. Assuming that the cutting ports are arranged equally in three planes, the spacing or circumferential center to center distance between the holes in each of frustoconical plane will be 4.57 or 0.565 inch.

Assuming, as previously stated, that the perpendicular plane A and the tilted frustoconical planes B and C are separated on the outside surface of the head 18*a* by one port hole diameter 0.055, the head can be constructed as follows to provide the configuration shown in FIG. 3. Twenty-Five port holes are drilled in perpendicular plane A with circumferential centerline spacing of 0.565 inches. Then using any port hole in perpendicular plane A as a reference, 25 port holes are drilled in plane B starting at a circumferential distance of 0.283 inch from the referenced port hole of plane A. Thus, with reference to the sets of holes shown in FIG. 3, hole 25 is radially displaced along the circumference of the head from hole 24 by a distance of ½ the centerline spacing or 0.283 inch. The same procedure can be used to drill the holes in plane C so that, again, hole 26 is drilled a radial distance from hole 24 of 0.283 inch. In this configuration, the holes of planes B and C are staggered with respect to the holes in plane A, but are in line with one another. An alternative configuration can be employed in which the holes of all three planes are staggered with respect to one another. In this case, the holes in plane B can be drilled starting from the reference hole of plane A by a distance of ⅓ of the center to center hole spacing or 0.188 inch. The holes in plane C can similarly be drilled, here starting by a radial distance along the circumference of the cutting head of 0.376 inch from the reference hole. The result, of course, would be a configuration in which the cutting ports in each of planes A, B and C are staggered with respect to one another.

Figure 5:
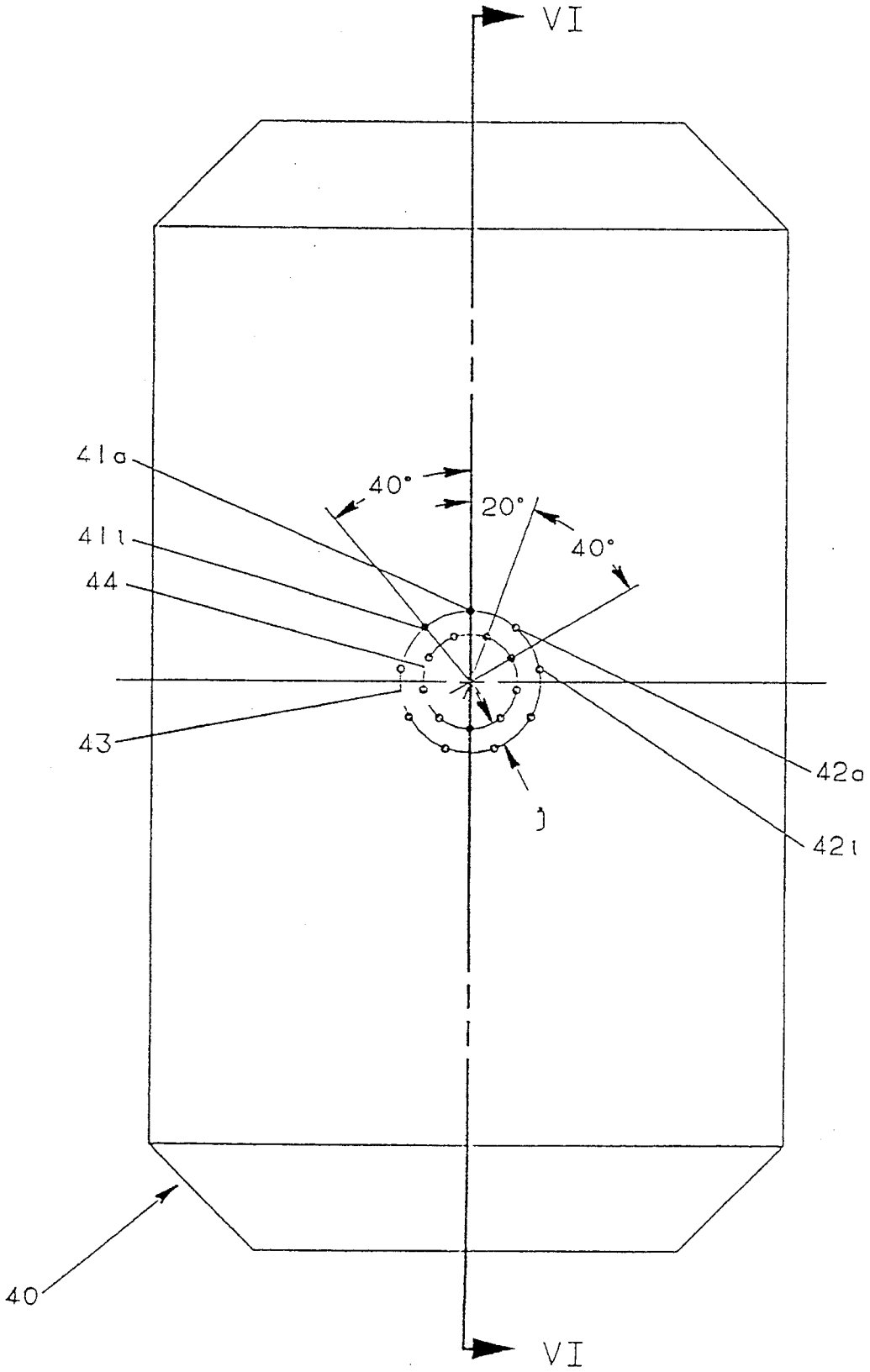
FIG. 5 is a side elevational view of a cutting head incorporating cutting ports in accordance with another embodiment of the invention.
Figure 6:
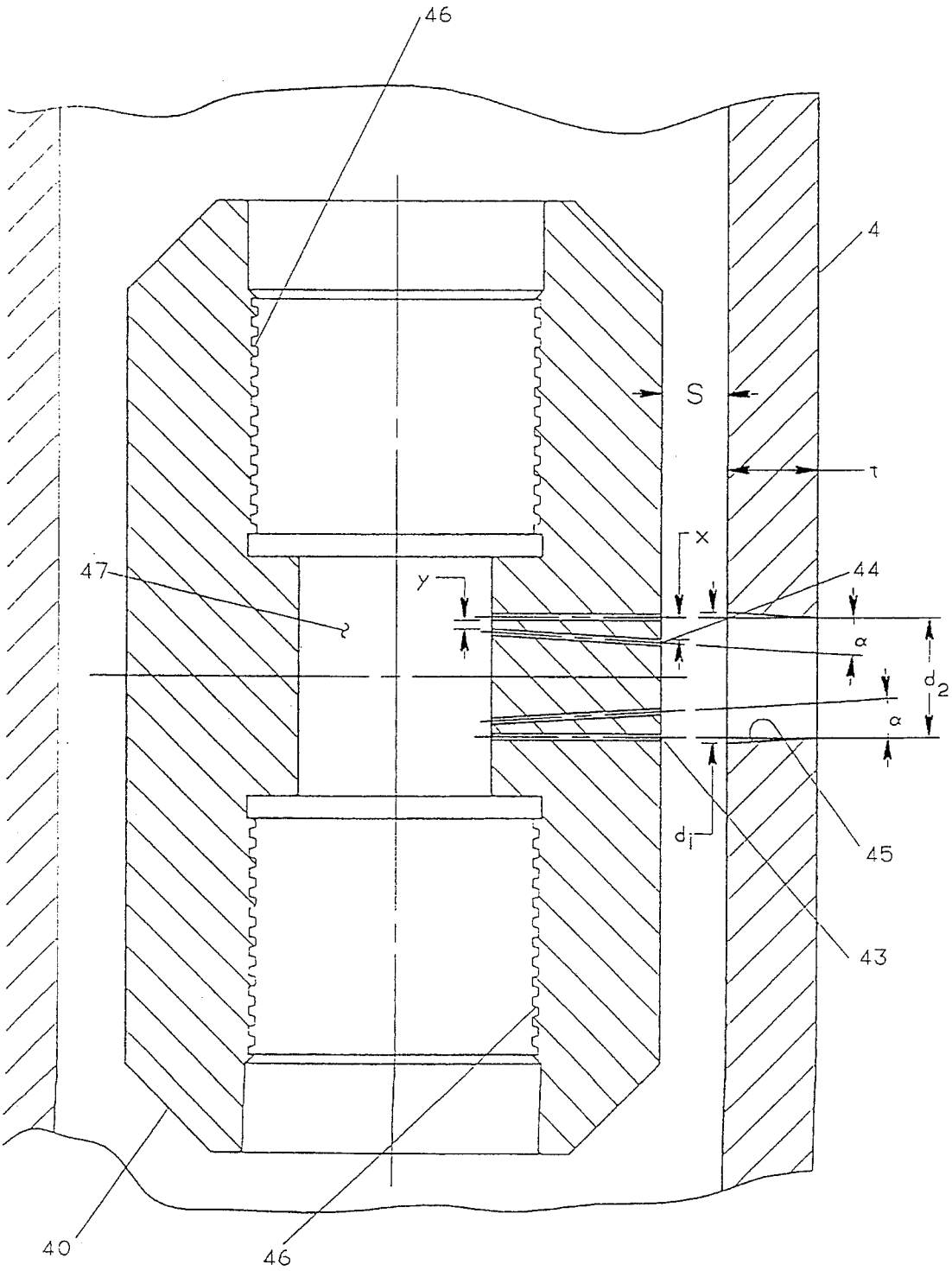
FIG. 6 a longitudinal sectional view taken along line 6—6 of FIG. 5 and showing the cutting head within a tubular member.

Turning now to FIG. 5, there is shown an embodiment of the invention in which the loci of cutting port holes 41*a*–41*i* and 42*a*–42*i* are conformed in circles 43 and 44, respectively, on the surface of the head 40 from a centrally located perpendicular view with respect to the vertical axis of head 40. The head 40 is to be used in the head assembly of FIG. 1 (in place of head 18*a*) to perforate a large perforation 45 in pipe 4 as shown in FIG. 6. To illustrate the principle of constructing head 40 of this alternative embodiment, an actual example is given using the parameters listed in the following Table 1.

TABLE 1

| |
|---|
| Outside Diameter of pipe = 5 ½ inches |
| Outside Diameter of head = 4 ½ inches |
| Pipe Wall Thickness T .250 inches |
| Standoff, (S) = .25 inches |
| Perforated Pipe Hole 45 diameter = 1.0 inch (approximately) |
| Cutting Port Hole Diameter 0.055 inch |

The threads 46 and bore 47 are machined into head 40 by standard machining techniques. Then, nine port holes 41*a* through 41*i* in FIG. 5 are drilled to where the vertical center of each symmetrical port hole 41*a* through 41*i* is circumferentially located on the imaginary fiducial surface of a one inch cylinder whose circumference 43 is centrally located perpendicular to the vertical axis of head 40. Empirical considerations indicate that nine equally spaced port holes should be provided in each of cutting patterns which are the imaginary fiducial surface locations 43 and 44. The nine port holes 42*a* through 42*i* are drilled to where the vertical center of each port hole 42*a* through 42*i* is circumferentially located on a fiducial surface in the form of a truncated cone centrally located and of such a diameter and height that the exit loci of port holes 42*a* through 42*i* describe a circle 44 as viewed from a perpendicular location with respect to the vertical center of head 40. The circumference of circle 44 is separated from circle 43 by a constant separation distance of three port hole diameters, i.e., 0.165 inch as shown in FIG. 6. Empirically, the distance y should be the diameter of one port hole, which is the vertical internal surface distance of the exit loci of the port holes drilled by the imaginary fiducial surface locations patterns 43 and 44. As is also indicated in FIG. 5 the cutting ports in pattern 44 are on a different radii than the cutting ports in pattern 43. Specifically, the angle between adjacent radii of the cutting ports in a given pattern is 40° and the cutting ports on the inner pattern 43 are located midway between the cutting ports on the outer pattern 43, i.e., the closest cutting ports when going from one pattern to the next, lie on radii spaced 20° as shown in FIG. 5.

The use of head 40, appropriately connected to the chemical cutter 7 of FIG. 1 in place of cutting head 18*a* (this configuration is not shown), results in maximum penetration capabilities, requiring a minimum quantity of cutting fluid. The inside diameter $d_1$ of the perforation 45 may be twice as large in area as the outside diameter $d_2$ as shown in FIG. 6. Finally, as shown in FIG. 6, if the loci of the port holes 41*a*–42*i* and 42*a*–42*i* are drilled as delineated herein, the port holes 41*a*–41*i* will be skewed an angle of absolute value calculated as follows:

$$\tan \alpha = \frac{x-y}{.5\ (\text{Head outside diameter} - \text{head bore } 47)}$$

$$\tan \alpha = \frac{.165 - .110}{.5\ (4.5 - 1.630)}$$

$$\tan \alpha = \frac{0.055}{1.435} = .03833$$

$$\alpha = 2.19°$$

Therefore, the imaginary fiducial surface location pattern 44 of FIG. 5 will be skewed with respect to the imaginary fiducial surface location pattern 43 at an angle $\alpha$=2.19° as shown in FIG. 6.

Figure 7:
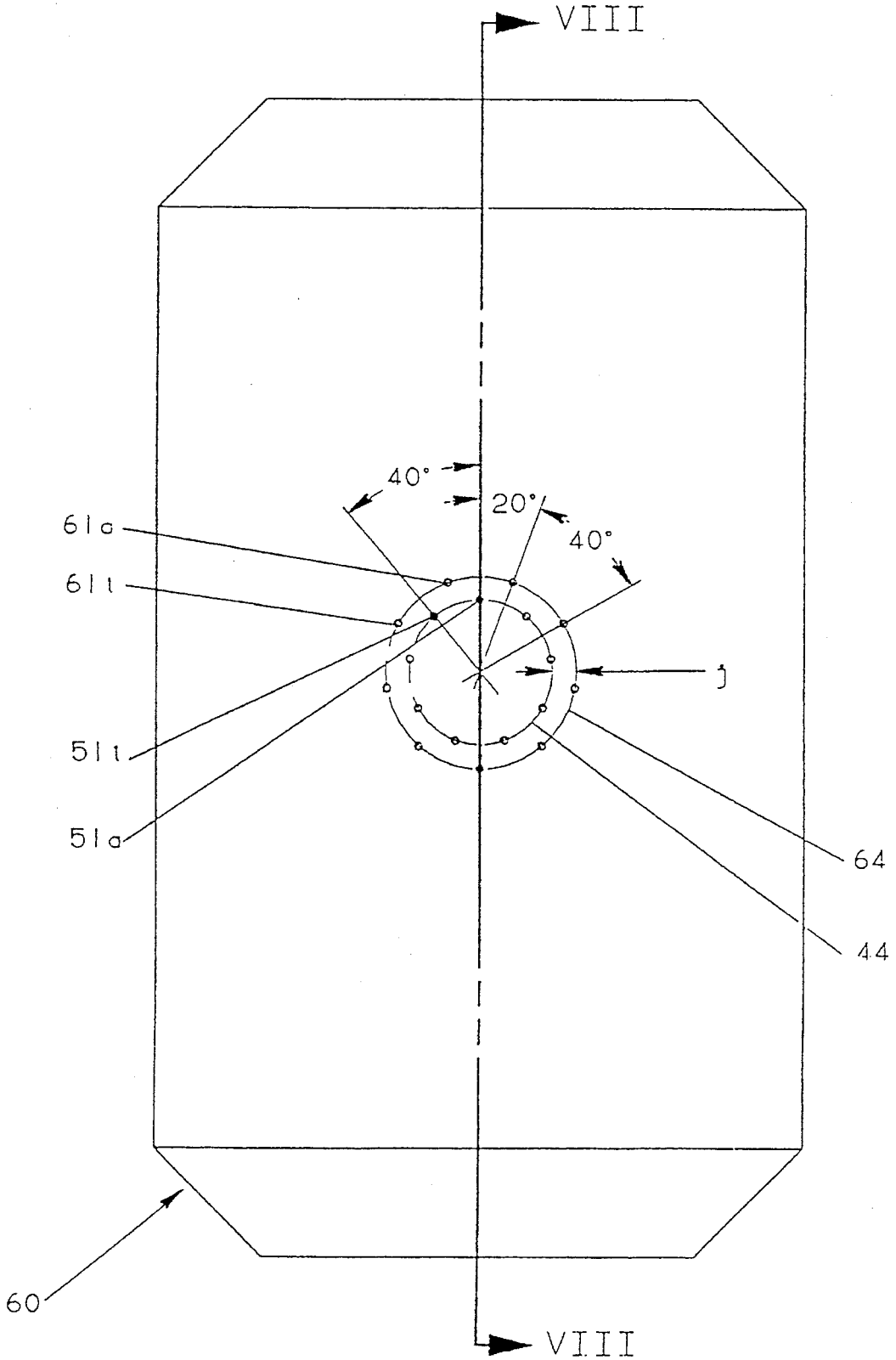
FIG. 7 is a side elevational view showing a cutting head with an arrangement of cutting ports in accordance with yet another embodiment of the invention.
Figure 8:
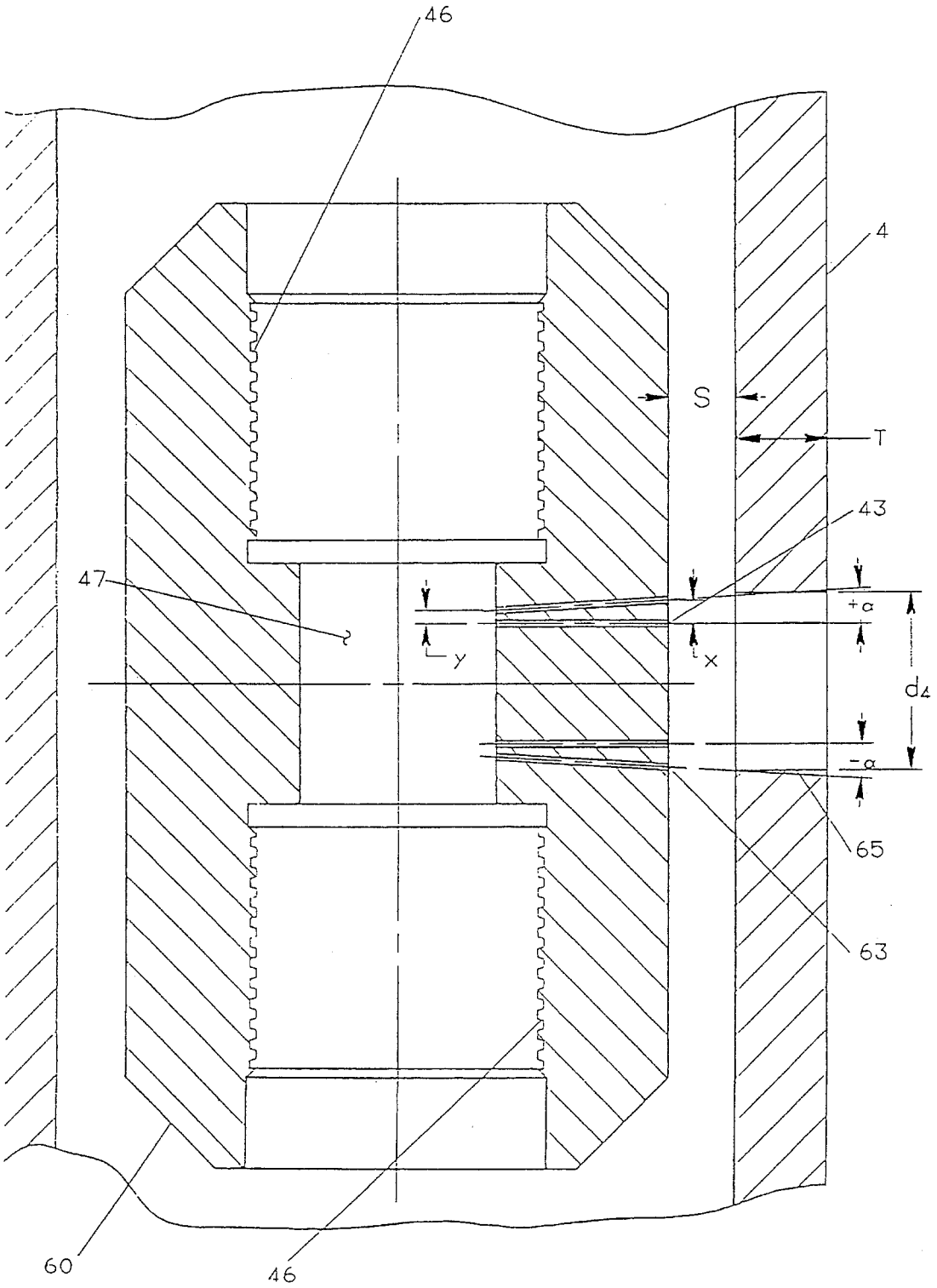
FIG. 8 is a side elevational view taken along line 8—8 of FIG. 7 showing the cutting head disposed within a tubular member.

Turning now to FIGS. 7 and 8, there is illustrated yet another embodiment of the invention employing a cutting head 60 which is similar to the embodiment shown in FIG. 5 and 6 but with the cutting ports configured to produce a perforation in the tubing 4 having approximately equal inside diameters. FIGS. 7 and 8 are similar, respectively, in their views to FIGS. 5 and 6. FIG. 7 indicates a planar projection of a side elevation of the cutting head 60. FIG. 8 is a sectional view through the cutting head as located within the tubing 4 along section line 8—8 of FIG. 7.

Referring to FIGS. 7 and 8, cutting head 60 is constructed to produce a chemically cut perforation 65, FIG. 8, in the pipe 4 for which the inside diameter $d_3$ is approximately equal to the outside diameter $d_4$ in pipe 4 when head 60 is functionally deployed downhole connected to a chemical cutter 7, FIG. 1 (this configuration is not shown). In the construction of head 60 threads 46 and bore 47 are machined into head 60 by standard machining techniques. Then nine cutting port holes 61*a* through 61*i* are drilled to where the vertical center of each symmetrical port hole 51*a* through 51*i*, FIG. 7, is circumferentially located on the imaginary fiducial surface of a one-inch cylinder centrally located perpendicular to the vertical center of head 60. Similarly, as described above with regard to FIGS. 5 and 6, the number of equally spaced port holes should be equal to nine to achieve the most effective penetration of pipe 4. Then nine port holes 61*a* through 61*i* are drilled to where the vertical center of each port hole 61*a* through 61*i* is circumferentially located on the imaginary fiducial tessellated surface of a truncated cone central located and of such a diameter and height that the exit loci of port holes 61*a* through 61*i* describe a projected circle 64. The projected circle 64 is separated from the projected circle 63 by a constant separation distance of three port hole diameters, 0.165 inch. The chemically perforated hole 65 that is produced in pipe 4 by the use of head 60 appropriately connected to the chemical cutter 7 of FIG. 1 results in maximum penetration capabilities requiring a minimum quantity of cutting fluid. Additionally, the inside diameter $d_3$ of the perforation 65 is almost equal to the outside diameter $d_4$. Finally, as shown in FIG. 7, if the loci of the port holes 51*a*–51*i* and 61*a*–61*i* are drilled as delineated here; the port holes 61*a*–61*i* will be skewed an angle $\alpha$ as shown in FIG. 8 of 2.19°, for the parameters given above in Table 1.

The chemical cutting agent used to carry out the present invention may be of any suitable type as may be required depending upon the nature of the material in the tubular goods to be cut. As a practical matter, the chemical cutting agent normally will take the form of a halogen fluoride, specifically bromine trifluoride, as described previously. Other chemical cutting agents which can be used in the present invention can include nitrogen fluoride and mixtures of nitrogen fluoride and molecular fluorine as described, for example, in the aforementioned U.S. Pat. No. 4,619,318 to Terrell et at. As described there, a preferred form of such cutting agent comprises approximately equal parts of nitrogen, fluoride and fluorine. The gaseous chemical cutting agent may contain nitrogen fluoride in the form of nitrogen trifluoride ($NF_3$) tetrafluorohydrazine ($N_2F_4$) and difluorodiazine ($N_2F_2$) compounds. Nitrogen trifluoride disassociates at elevated temperatures of about 1100° K.–1500° K. into the free radical $NF_2$ and fluorine. It also pyrolyses with may of the elements to produce tetrafluorohydrazine and the corresponding fluoride. Tetrafluorohydrazine also disassociates at elevated temperatures in a reversible reaction to form the free radical $NF_2$. In practice, it is preferred that the cutting agent contain nitrogen trifluoride since it is a thermodynamically stable gas at the temperatures usually encountered and is available in commercial quantities.

The cutting agent source may comprise a solid perfluoroammonium salt which decomposes upon heating to produce a gaseous chemical cutting agent containing nitrogen fluoride. Suitable perfluoroammonium salts which may be employed in this regard include $NF_4SbF_6$, $NF_4ASF_6$, $NF_4Sb_2F_{11}$, $NF_4Sb_3F_{16}$, $(NF_4)_2TiF_6$,$(NF_4)SnF_6$, $NF_4SnF_5$, $NF_4BiF_6$,$NF_4BF_4$, $NF_4PF_6$, and $NF_4GeF_5$. These salts, when heated to temperatures on the order of about 300° C. and above, decompose to form $NF_3$ and $F_2$. For a further description of such cutting agents, reference is made to the aforementioned U.S. Pat. No. 4,619,318, the entire disclosure of which is incorporated herein by reference.

Regardless of the chemical cutting agent used, it is highly desirable to use a multicomponent ignitor material as described above. The ignitor material may take the form of an "ignitor hair" such as steel wool or other similar metal having an intermeshing filamentary structure in a mixture with a second component formed of a corrosion resistant metal. As noted previously, steel wool, or steel wool mixed with an oil or another hydrocarbon, has conventionally may be used as an ignitor material in chemical cutting applications. However, a preferred application of the invention involves the use of an ignitor hair composite that raises the exit temperature of the cutting fluid to a value higher than that achieved either by steel wool itself or mixed with hydrocarbons. Second metal components which may be used to raise the temperature substantially include chips, powders or shavings of metals such as chromium, nickel, titalium, titanium. Shavings from the same material as the material to be cut may be either mixed with the steel wool to form a composite ignitor.

In some cases, the ignitor hair need not contain iron but can be formulated of a predominantly non-ferrous material. For example, stainless steel shavings and non-ferrous powders, chips or filings can be used without the presence of steel wool, but mixed with oil or a similar organic material to effect initiation of the ignitor material. Various other materials which can be employed depending upon the nature of the material being cut can include steel wool plus stainless steel or steel wool plus shavings of nickel and chromium, tantalum and titanium. Usually, such mixtures will include grease, oil or other organic starter material.

In a preferred embodiment of the invention where the tubular goods to be cut are formed of high nickel chromium stainless steel or other similar material, a two-component ignitor hair can be used to facilitate pre-ignition of the cutting agent to the desired cutting temperature. The second metal component can be characterized as being more corrosion resistant than the first component due to the alloy mixtures which normally will be encountered in the second component. The second metal component can be tailored to the particular tubular goods to be cut and this can be most readily accomplished by simply forming shavings from an article formed of the same alloy as that forming the tubular goods which are to be cut in the well. Preferably, the shavings also are of a filamentary nature which is integrated throughout the steel wool or other first metal component. Alternatively, chips or discrete particles such as stainless steel chips can be incorporated into the steel wool or other first metal component.

The operation of the two-component ignitor system can be illustrated by reference to use of the chemical cutting tool in cutting high nickel chrome stainless steel tubing which is used in oil wells subject to highly corrosive environments. Such tubing is formed of an alloy which may contain high mounts of chromium, e.g., 18 wt. % or more, and nickel in an amount of perhaps 50% of the chromium content. For example, such steel may contain in addition to iron and minor amounts of carbon, chromium in an amount of about 18 wt. % and nickel in an amount of about 8 wt. %. As indicated previously the nickel content may be substantially higher and in an amount approaching twice that of the chromium content. For example, the invention is highly effective in cutting so-called "duplex 22" stainless steel tubing which has a chromium content of about 22 wt. % and a nickel content of about 42 wt. %. Tubing of this nature is used in so-called "sour gas" wells of the type described previously where the temperature can be in excess of 150° C. The present invention employing preferred composite formulation of ignitor material is highly effective in cutting such tubing under these conditions. Where the preferred bromine trifluoride is used as a cutting agent, it can be expected to react exothermically with iron at a temperature of about 1250° F. and with nickel at about 2100° F. Chromium will react at a temperature between iron and nickel. Thus, in operation the iron (steel wool) component will react initially with the chemical cutting agent and the nickel or chromium, or more likely high nickel chromium stainless steel cuttings, will react with the already heated chemical cutting agent to boost the temperature still further so that it is at an appropriate temperature for immediately cutting the tubular goods as it exits the cutting head and impinges upon the interior surface of the tubing.

As a practical matter, the weight ratio of the two metal components will be within the range of about 1:3–3:1 and more preferably, usually in about 1:1 ratios. In addition, the ignitor material normally will contain a small mount of hydrocarbon such as grease or the like. For example, in an intermediate size chemical cutting tool adapted to cut tubing string having an inner diameter of about 3 inches, the ignitor hair may take the form of 4 grams of steel wool, 4 grams of hydrocarbonaceous grease and 4 grams of chromium chips or alternatively and more preferably, shavings of the same material as that forming the tubular member to be cut.

Other relative amounts of these ignitor components may be used. For example, the hydrocarbonaceous grease may be present in an amount within the range of 20–30 wt. %, steel wool in an mount within the range of about 15–20 wt. % and the chromium shaving present in an amount within the range of 60–75 wt. %. A suitable mixture of these materials for use in cutting duplex 22 stainless steel tubing as described above in a small diameter chemical cutter, i.e. one having a 2⅛" outside diameter at the cutting head, contains about 3 gms of hydrocarbonaceous grease, about 2 gms of steel wool and about 6–8 gms of pure chromium shavings.

A further application of the present invention provides a chemical cutting tool which can be effectively used in cutting downhole tubular members of relatively large diameters which are formed of corrosion resistant metal alloys of the type described previously. This is accomplished through the use of a cutting head configuration which can be used in conjunction with slip means which are operable through a relatively wide distance to provide a suitable stand-off distance from the cutting head to the surface to be cut. A chemical cutting tool incorporating a suitable cutting head and slip configuration is disclosed in the aforementioned U.S. Pat. No. 5,287,920. This embodiment of the invention further involves a single tool which can be used repeatedly in different hard-to-cut conduits over a wide range of diameters through the use of two or more sets of externally upset cutting heads which can be interchanged with one another to accommodate casing strings or other conduits of different sizes. This cutting tool embodies a multi-component anchoring system which can be used to effectively stabilize a cutting tool having a relatively small external diameter within a conduit of a relatively large internal diameter. The centralizing system provides a means for generally centralizing the tool as it is run in the well and at the same time can be partially deployed to act as a guard to prevent damage to the cutting head. The cutting head configuration enables the use of localized accumulations of multi-component ignitor materials of the present invention which effectively acts as a pre-ignitor for the cutting agent immediately before it is dispelled through the cutting ports and impinged against the interior surface of the conduit to be severed or otherwise cut.

Figure 9:
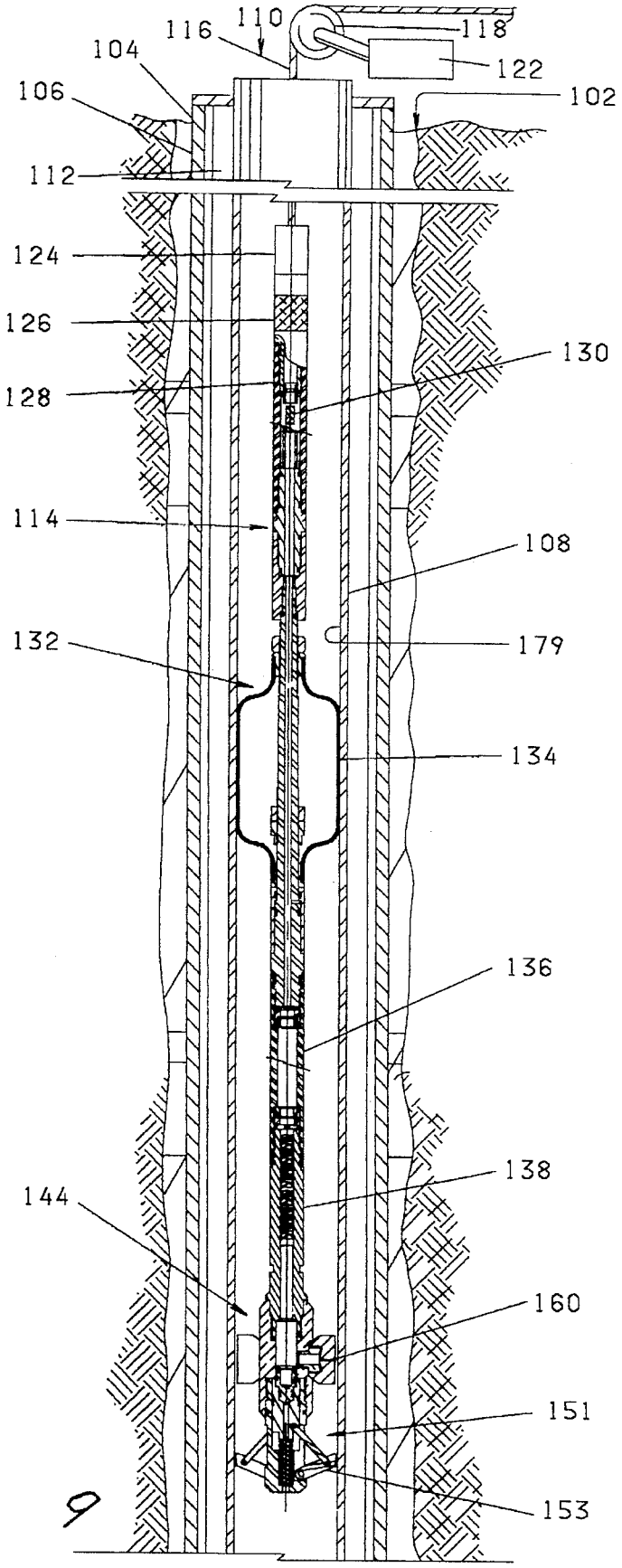
FIG. 9 is an illustration, partly in section, showing a further embodiment of a downhole chemical cutter embodying the present invention located in a well.

For a further description of the present invention, reference will be made to FIGS. 9 through 11 of the drawings. As shown in FIG. 9, there is illustrated a chemical cutting tool embodying the present invention disposed within a well extending from the surface of the earth to a suitable subterranean location as described previously. As is illustrated in FIG. 9, a well bore 102 is provided with a casing string 104 which is cemented in place by means of a surrounding cement sheath 106. A large diameter tubing string 108 is disposed in the well as illustrated and extends from the well head 110 to a suitable downhole location. The tubing string and/or the annular space 112 between the tubing and the casing may be filled with high pressure gas and/or a liquid or it may be "empty" as described previously.

As further illustrated in FIG. 9, a chemical cutting tool 114 is suspended from a cable (wireline) 116 and threadedly connected to cable 116 via a cablehead 124. The cable 116 passes over suitable indicating means 118 to a suitable support and pulley system 120. An indicator 122 which gives a readout of the depth at which the tool is located. Similarly as described above, the tool 114 can be employed in severing a drill pipe in either a cased or uncased well.

The chemical cutter 114 is composed of five sections. At the upper end of the tool there is provided a fuse assembly 126 comprised of a fuse sub and an electrically activated fuse (not shown). Immediately below the fuse assembly 126 is a propellant section 128 which provides a source of high pressure gas. For example, the propellant section 128 may take the form of a chamber containing a propellant, such as gun powder pellets 130, which bums to produce the propellant gases.

Immediately below the propellant section 128 is a bow spring section 132 incorporating a plurality of multi-layered bow springs 134 that serve at least one and preferably two functions for the cutting tool incorporating the large composite heads of the present invention. Firstly, the bow spring arms 134 can be mechanically adjusted to provide a force generally normal to the vertical axis of the tool of sufficient magnitude to keep the large composite head assembly 144 described below, from dragging against the inside surface of the pipe 108 being cut. Therefore, the head assembly 144 is protected from sliding friction as the head assembly 144 is lowered down the well to lessen the likelihood of severe damage to the large composite head assembly 144. Secondly, as described in U.S. Pat. No. 5,287,920, a vertically slidable piston in the tool applies an additional force to expand the multi-layered bow spring arms 134 during the cutting cycle. This results in "fine tuning" of the centralization function plus providing an anchoring force during the cutting cycle. This slidable piston is activated by the gas pressure generated during the cutting cycle. Where this embodiment is incorporated into the tool with extremely large composite head assemblies, the propellant section 128 may be supplemented with a second gas generating power unit (not shown) below the bow spring assembly 132.

A chemical module section 136 is located below the centralizer section 132. An optional ignitor sub 138 may be located immediately below the chemical module section 136. The composite head assembly 144 is in turn located below the ignitor sub 138 or the chemical section 136 in FIG. 9, as the case may be. The composite head assembly 144 comprises a head sub 150 with a plurality of externally upset cutting heads 160 extending outwardly from the head sub 150 and located about the periphery of the head sub. As described below, the cutting heads preferably are composite structures formed of disks 161 and individual threaded appenditures or "spokes"162 which are connected to the head 150 like a center hub of a wheel. This composite construction will henceforth be referred to as a "wagon wheel" head based upon its general appearance. In the disks 161 are located a plurality of the cutting ports 146 where the chemical exits the composite head assembly 144 and is directed against the interior wall of the tubular member 108. Below the head assembly 144 is a slip assembly 151 comprising an array of slip elements 153 disposed peripherally of the tool. The slip assembly 151 centralizes the tool in the pipe and holds the tool stationary while the pipe is being cut.

The configuration of the cutting tool shown in FIG. 9 employing both the bow spring assembly 132 with an anchoring function and the slip assembly 151 is a preferred configuration. However, as described in greater detail in the aforementioned U.S. Pat. No. 5,287,920, one of these assemblies can be used in the chemical cutting tool without the presence of the other.

Figure 10:
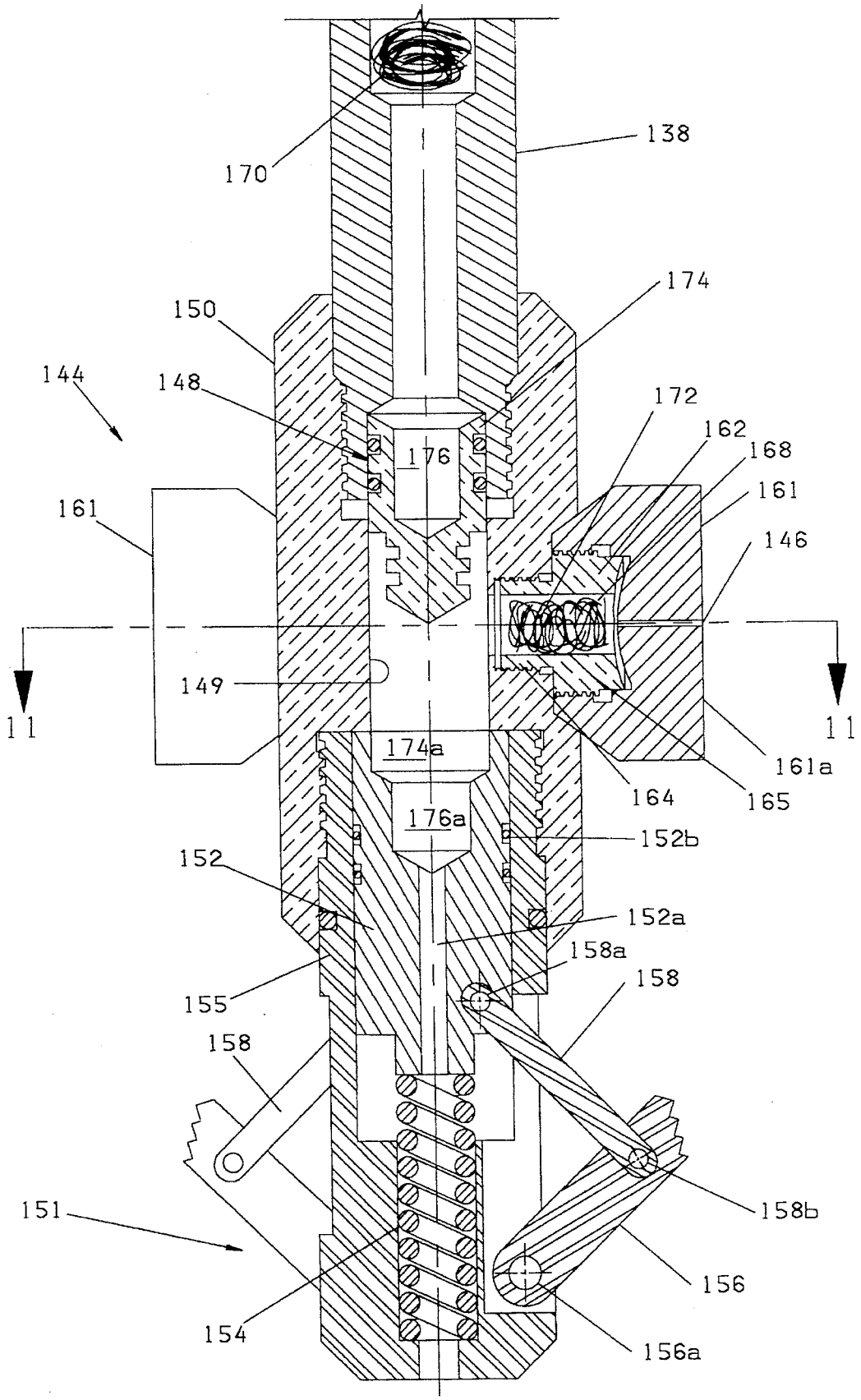
FIG. 10 is a side elevational view, partly in section, showing a preferred form of head assembly of the, tool of FIG. 9.
Figure 11:
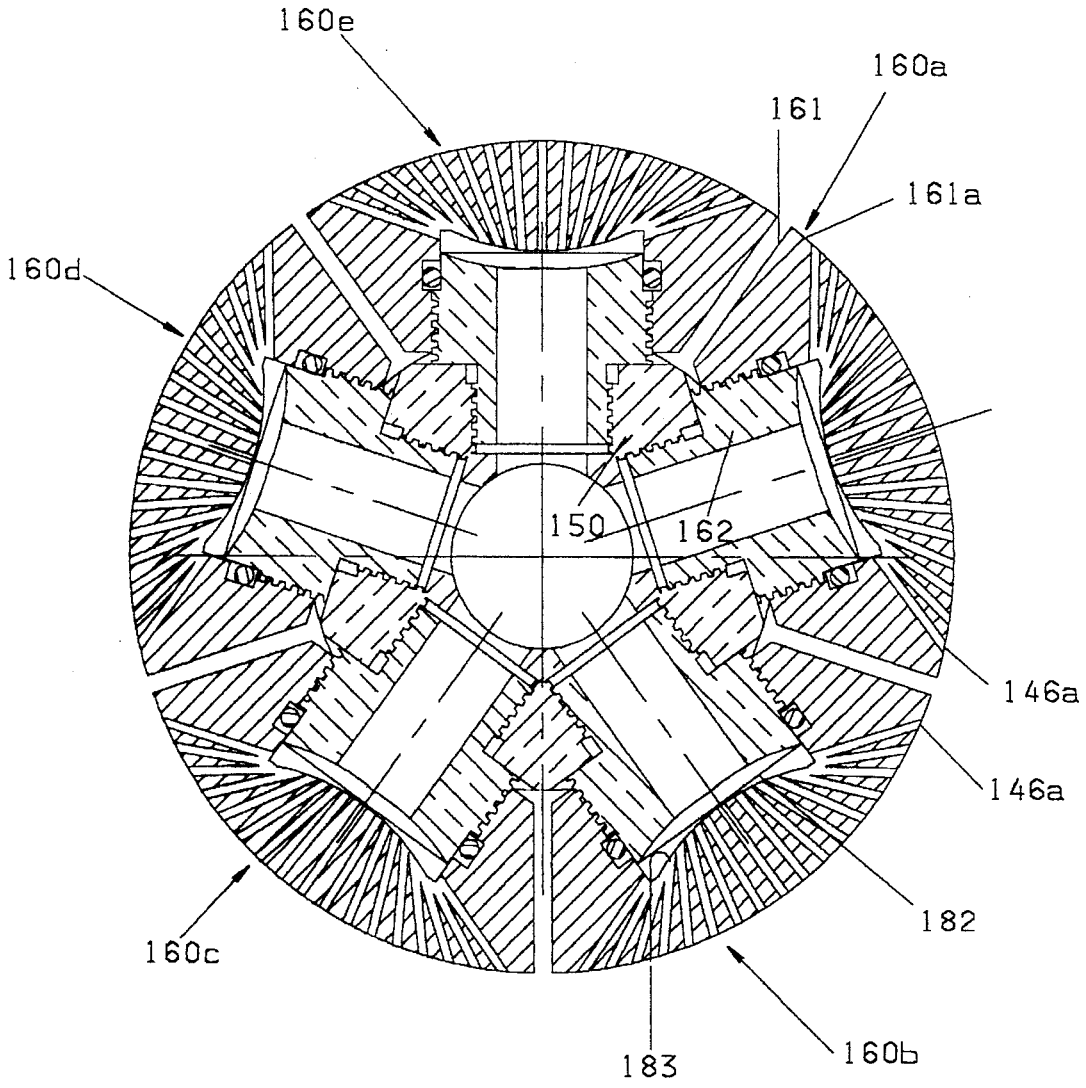
FIG. 11 is a sectional view taken along line 11—11 of FIG. 9, showing a preferred arrangement of multi-component cutting head.

FIG. 10 illustrates a side elevation with parts in section of a cutting head assembly 144 and the lower portion of an optional ignitor sub 138 located immediately above the head assembly. As shown in FIG. 10, the head assembly includes a piston plug 148 slidably disposed within the central bore 149 of head 150. A slip support body 155 is threadedly secured to the bottom of the head mandrel 150 and thus supports the slip assembly with secondary piston 152 slidably disposed within the slip support 155 against the action of a compression spring 154. The secondary piston 152 is provided with a central bore **152*a* which provides for pressure equalization above and below the secondary piston and a plurality of o-ring seals 152*b* and 152*c*. The secondary piston 152 has an upper sectionalize bore 176*a* adapted to receive the primary piston 148** in a wedged relationship as described in greater detail hereinafter.

The slip assembly comprises a plurality of slip arms 156 and corresponding thrust arms 158. As shown in FIG. 10, slip arm 156 is pivotedly connected to plug 155 at bearing pin **156*a* and thrust arm 158 is connected to the secondary piston 152 at beating pin 158*a* and to slip arm 156 at bearing pin 158*b***.

The preferred composite cutting head construction is illustrated in FIG. 10. As shown, the cutting head comprises a disk portion 161 which terminates in an outer cutting surface **161*a* externally upset from the head section by the desired distance to provide the appropriate stand-off distance from the surface to be cut. The disk portion 161 is threadedly secured to an inner spoke section 162 having an externally threaded reduced section 164 and an externally threaded enlarged section 165 to which the disk 161 is secured. The enlarged and reduced sections form a shoulder 166 which abuts against the conforming surface in the cutting head 150. The disk section 161 is threaded onto the exterior surface of the enlarged section 165 of spoke 162 and also is in an abutting relationship with the conforming surfaces on the cutting head 150. The spoke section has an enlarged interior bore 168 into which the radially extending cutting ports 146 extend. Preferably, the interior bore contains a multi-component ignitor mass 172** in order to effect efficient pre-ignition of the cutting agent immediately before it exits the cutting ports.

As shown in FIG. 10, an optional ignitor sub 138 containing ignitor hair 170 may also be provided. One or both of these pre-ignitor materials can be used in the cutting tool depending upon the nature of the cut and the nature of the material to be cut. Where ignitor masses 170 and 172 are both used, they may be the same or different materials and each may, in turn, be formed of several components. By way of example, ignitor mass 170 may be formed of steel wool, a steel wool grease mixture or other like material which reacts with the chemical cutting agent at a more moderate temperature than the exothermic reaction occurring when the cutting agent reacts with the ignitor material 172 in the interior bore 168 of the cutting head spoke. For example, ignitor material 170 may be formed of steel wool or steel wool and grease and ignitor material 172 formed of two or three component mixture of steel wool or grease as a promoter and containing an ignitor component formed of stainless steel or chromium chips or shavings as described above. The ignitor material 172 may also be formed of a single component such as chromium or alloy shavings.

The piston plug 148 preferably has an enlarged section 174 adapted to fit into a conforming enlarged bore **174*a* in secondary piston 152 and a reduced section 176 adapted to fit into a reduced counter sink bore 176*a* in the secondary piston 152. Preferably, the enlarged section 174 is bored out to provide a bore 178 as shown and the reduced section is provided with one or more grooves 180** as shown. This not only lightens the plug, it also accommodates the wedging action of the piston plug into the secondary piston as described below.

The operation of the chemical cutter tool 114 of FIGS. 9 and 10 may be described briefly as follows. The tool is run into the well on the wireline 116 to the desired depth at which the cut is to be made and then fired by an electric signal similarly as described above. As the propellant 130 burns, the resulting high pressure gas forces the multi-layered bow spring arms 134 outwardly in a manner described hereinafter. The bow spring arms 134 thus centralize and anchor the chemical cutter tool 114 in the tubing string 108. The seal diaphragms within the chemical module section 136 are ruptured and the chemical cutting agent is forced into the head section 144. Here, the chemical forces the piston plug 148 through the head 150 wedging the piston into the secondary piston 152. This ensures that the plug remains locked to the secondary piston at the conclusion of the cutting cycle. The secondary piston 152 travels downwardly compressing the return spring 154 and forcing the thrust arms 158, which are attached to the slip arm 156, outwardly. The slip arm 156 is then forced against the inside wall of the pipe 108, thereby centralizing and anchoring the tool stationary inside the pipe 108 while the pipe is being cut. When the piston plug 148 moves downwardly into the secondary piston 152, the piston plug 148 uncovers the exit holes in the head 150 and the chemical cutting agent is forced outwardly out of the head 150 into the spokes 162. Each spoke 162 preferably contains an accumulation of ignitor material comprising a promoter component and an ignitor component as described previously, which activates the halogen fluoride chemical, bringing it to a temperature that will dissolve the tubing 108. The halogen fluoride chemical is thus forced through the ignitor material, which pre-ignites the chemical. The gas pressure then forces the activated chemical into the disks and ultimately outwardly through the cutting ports 146. In a short period of time, normally a few seconds or less, the tubing 108 is severed, the pressure then equalizes itself inside and outside the chemical cutter tool 114 and the slip assembly 15 1 retracts due to the return action of the compression spring 154 at the bottom of the secondary piston 152. The chemical cutter tool 114 can be then withdrawn from the tubing string 108. For a further description of the general operating conditions and parameters employed in operation of a chemical cutter tool, reference may be made to the aforementioned U.S. Pat. No. 5,287,920, the entire disclosure of which is incorporated herein by reference.

As shown in FIG. 10, the slip arms, even when in the "retracted" position, extend radially outwardly of the tool body by a substantial distance. This configuration is preferred since the slip arms then act to at least partially shield the cutting disks 161 as the tool is lowered through the well. This arrangement thus reduces the likelihood that the cutting disks 161 will be damaged by debris within the well.

In one embodiment of the invention illustrated herein, the cutting head assembly carries five outwardly extending cutting heads. This arrangement is shown in FIG. 11, which is a sectional view taken through line 3—3 of FIG. 10 to show the five heads **160*a* through 160*e* arranged peripherally about the head section 150. As shown in FIG. 11 with reference to cutting heads 160*a* through 160*d*, the outer cutting surface 161*a* of each disk is arc-shaped, generally conforming with the interior surface of the tubular member to be cut, thus providing a generally uniform a desired stand-off distances from one cutting port to the next. Each disk 161 is threadedly secured onto spoke member 162, as described previously. Each disk 161 has a plurality of cutting ports arranged radially so that cutting fluid issuing through the ports impinges upon a designated segment of the conduit being cut. As shown in FIG. 11, the cutting ports 146*a* through 146*q* terminate on the inner surface 183*a* of the disk 161 spaced from the outer surface of the corresponding spoke 162 in order to define a plenum chamber as indicated by reference numeral 182. This feature provides for a uniform distribution of chemical cutting agents through the respective ports 146*a* through 146*q* shown in FIG. 11. It is to be recognized that the cutting ports in the several disks are to be configured so that the entire surface of the tubular member is contacted by cutting agent. Thus, the axis extended of port 146*q* of the disk 161*a* should intersect the axis extended of port 146*a* of disk 160*b*** at or before the interior surface of the tubular member to be cut in order to avoid "blank" surfaces, which are not effected by the cutting agent.

In this embodiment of the invention, the cutting ports in the disks are arranged in a plurality of groups of conforming patterns, similarly as described above with reference to FIGS. 3 through 8. One group of cutting ports is arranged in a configuration conforming to the desired shape of the cut and define a first planar pattern. A second group of cutting ports conform generally to the first pattern and are in a canted relationship with respect to the second pattern. Preferably, at least some of the cutting ports in the first group are in a staggered relationship longitudinally along the tool body relative to at least some of the cutting ports in the second group as shown in FIGS. 3 and 4.

In one configuration, the cutting ports in the disks are arranged such that when the disks are in place in the tool the ports extend circumferentially of the tool body to provide first and second planar patterns, generally normal to the major axis of the cutting tool. The planar patterns are in a converging relationship such that they intersect at a locus externally of the cutting disk surface as shown in FIG. 4. Another configuration is especially adapted to cut relatively large perforations in downhole tubular goods. Here, the cutting ports lie in first and second ring-shaped configurations in an annular relationship with one another as shown in FIGS. 5 through 8. The cutting ports within the inner ring configuration preferably are on different radii than the cutting ports in the outer ring to provide for an increased metal volume around the cutting ports.

Having described specific embodiments of the present invention, it will be understood that modifications thereof may be suggested to those skilled in the art, and it is intended to cover all such modifications as fall within the scope of the appended claims.

We claim:

1. In a downhole chemical cutting tool having an elongated tool body adapted to be inserted into a conduit and positioned at a downhole location thereof for effecting a cutting action in said conduit, the combination comprising:

a) a chemical section in said elongated tool body adapted to contain a chemical cutting agent;

b) a cutting section in said elongated tool body adapted to receive a chemical cutting agent from said chemical section;

c) a plurality of cutting ports in said cutting section for the discharge of chemical cutting agent therefrom extending transversely of the major axis of said elongated tool body;

d) an ignitor mass comprising an accumulation of permeable ignitor material interposed between said chemical section and said cutting ports;

e) said ignitor mass having an internal passageway within said accumulation of ignitor material extending between said chemical section and said cutting ports to facilitate fluid flow from said chemical section to said cutting ports; and f) said ignitor material comprising an ignitor component formed of a metal having a melting temperature in excess of 1600° C. and a promoter component in contact with said ignitor component to facilitate the reaction of said ignitor component and said chemical cutting agent.

2. The combination of claim 1, wherein said promoter component comprises a hydrocarbonaceous grease.

3. The combination of claim 1, wherein said promoter component comprises steel wool.

4. The combination of claim 3, wherein said ignitor component comprises chromium in an amount of at least 10 wt. %.

5. The combination of claim 3, wherein said ignitor component comprises a plurality of elongated cuttings.

6. The combination of claim 5, further comprising a hydrocarbonaceous grease interposed in said ignitor mass.

7. The combination of claim 6, wherein said ignitor mass comprises a plurality of transverse layers of said ignitor component and said promoter component.

8. The combination of claim 1, wherein said plurality of cutting ports is arranged in at least first and second groups, said first set of cutting ports being arranged in a configuration conforming to the desired shape of a cut to be made in the conduit and defining a first pattern and said second set of cutting ports defining a second pattern, generally conforming to said first pattern and being in a canted relationship with said first pattern.

9. The combination of claim 8, wherein said first and second groups of cutting ports are arranged circumferentially of said elongated tool body, in generally planar patterns which are generally normal to the major axis of said tool body.

10. The combination of claim 9, wherein said first and second planar patterns are in a converging relationship.

11. The combination of claim 10, wherein said first group of cutting ports defining said first planar pattern are in a downwardly converging relationship with respect to said second group of cutting ports defining said second pattern.

12. The combination of claim 11, wherein at least some of the cutting ports in said first group are in a staggered relationship longitudinally along said tool body relative to at least some of the cutting ports in said second group.

13. The combination of claim 1, wherein said first group of cutting ports are arranged in a ring-shaped configuration extending transversely from the longitudinal axis of said cutting tool and said second group of said cutting ports are arranged in a second ring-shaped configuration lying within and in an annular relationship to said first pattern.

14. In a downhole chemical cutting tool having an elongated tool body adapted to be inserted into a conduit and positioned at a downhole location thereof for effecting a cutting action in said conduit, the combination comprising:

a) a chemical section in said elongated tool body containing a chemical cutting agent;

b) a cutting section in said elongated tool body adapted to receive a chemical cutting agent from said chemical section;

c) at least one cutting port in said cutting section for the discharge of chemical cutting agent therefrom;

d) an ignitor mass comprising an accumulation of permeable ignitor material interposed between said chemical section and said cutting ports; and e) said ignitor material comprising an promoter component which is reactive with said chemical cutting agent in an exothermic chemical reaction at a first temperature and an ignitor component formed of a predominately non-ferrous, corrosion-resistant metal alloy which is reactive with said chemical cutting agent in an exothermic chemical reaction at a second temperature higher than said first temperature.

15. The combination of claim 14, wherein said ignitor component comprises chromium in an amount of at least 10 wt. %.

16. The combination of claim 15, wherein said ignitor component comprises a plurality of elongated filamentary cuttings.

17. The combination of claim 16, wherein said promoter component comprises a hydrocarbonaceous grease.

18. The combination of claim 16, wherein said promoter component comprises steel wool.

19. The combination of claim 16, wherein said promoter component comprises steel wool and a hydrocarbonaceous grease interposed in said steel wool.

20. The cutting tool of claim 14 wherein said cutting section has an interior chamber for the distribution of said chemical cutting agent and a plurality of externally upset cutting heads extending outwardly from said cutting section along circumferentially spaced transverse axes and having outer cutting surfaces, each of said cutting heads having a plurality of cutting ports extending radially inward from the outer cutting surface thereof and in fluid communication with said internal chamber within said cutting section.

21. The combination of claim 20, wherein each of said cutting heads comprises an inner spoke section secured to the cutting section of said tool body and having a central bore therein opening into the interior chamber of said cutting section and further comprising a disk section having said outer cutting surface secured to said spoke section and said cutting ports are located in said disk section extending from the cutting surface to said central bore, and at least a portion of said accumulation of permeable ignitor material is disposed in the central bores of said spoke sections.

22. In a well penetrating into the earth from a well head to a subterranean location, the combination comprising:

a) a tubular conduit within said well formed of a corrosion resistant metal having a greater resistance to corrosion than low carbon steel;

b) downhole chemical fluid jet cutting tool within said well at a downhole location;

c) a cable extending from the well head downwardly to said cutting tool and supporting said tool in said well, at said downhill location;

d) means for raising and lowering said cable and said cutting tool within said well;

e) said cutting tool comprising an elongated tool body;

f) anchoring means in with said tool body for anchoring said tool at a downhole location in response to the application of fluid pressure and for releasing said tool body in response to the release of said fluid pressure;

g) a chemical section in said tool body having a chamber therein adapted to containing a cutting fluid;

h) a cutting section in said tool body having a longitudinally extending bore in fluid communication with said chemical section whereby upon the application of pressure to said chemical section, said chemical cutting agent is forced into said cutting section;

i) a pressure generating section within said tool body within which pressure is generated to actuate said anchoring means and to displace said cutting agent into said cutting section; and j) a plurality of cutting ports in said cutting section for the discharge of chemical cutting agent therefrom extending transversely of the major axis of said elongated tool body;

k) an ignitor mass comprising an accumulation of permeable ignitor material interposed between said chemical section and said cutting ports;

l) said ignitor mass having an internal passageway within said accumulation of ignitor material extending between ports to facilitate flow from said chemical section to said cutting ports;

m) said ignitor material comprising an ignitor component formed of a metal having a melting temperature in excess of 1600° F. and a promoter component in contact with said ignitor component to facilitate the reaction of said ignitor component and said chemical cutting agent.

23. The combination of claim 22, wherein said cutting ports are arranged in at least first and second groups, said first group of cutting ports being arranged in a configuration conforming to the desired shape of a cut to be made in the conduit and defining a first planar pattern and said second group of said cutting ports defining a second planar pattern generally conforming to said first pattern and being in a canted relationship with said first pattern.

24. In a method of cutting tubular well goods at a downhole location within a well extending into the earth from a well head, the steps comprising:

a) inserting into said well a chemical cutting tool having a chemical section containing a chemical cutting agent adapted to interact with a corrosion resistant tubular member in said well to form a cut in said tubular member and further having a cutting section adapted to receive said cutting agent from said chemical section;

b) lowering said chemical cutting tool through said well to a desired location within said tubular member at which said cut is to be made;

c) discharging said cutting agent from said chemical section into contact with an ignitor material to effect an exothermic pre-reaction of said chemical cutting agent, said ignitor material being formed in a permeable accumulation of a promoter component formed of a material which is reactive with said cutting agent in an exothermic reaction at a first temperature and an ignitor component formed of a metal interposed with said promoter component and which is reactive with said cutting agent in an exothermic reaction at a second temperature higher than first temperature;

d) dispensing said pre-ignited chemical cutting agent from said cutting tool in a plurality of jet streams emanating from a plurality of cutting ports in the cutting section of said tool and into the contact with the inner surface of said tubular member to effect a cut in said tubular member.

25. The method of claim 24, wherein said promoter component comprises a hydrocarbonaceous grease and said ignitor component comprises a metallic component comprised of a metal selected from the group consisting of tungsten, nickel and chromium and mixtures thereof.

26. The method of claim 25, wherein said ignitor material comprises a first metallic component selected from the group consisting of tungsten; nickel and chromium and mixtures thereof, a hydrocarbonaceous grease component present in an amount less than the amount of said hard metallic component and a steel wool component present in an amount less than the amount of said hard metallic component.

27. The method of claim 26, wherein in said steel wool is present in an amount less than said hydrocarbonaceous grease.

28. The method of claim 27, wherein in said first metallic component is present in an amount within the range of 50–70 wt. % of said ignitor material, said steel wool component is present in an amount within the range of 10–15 wt. % of said ignitor material, and said hydrocarbonaceous grease component is present in an amount with the range of 20–30 wt. % of said ignitor material.

* * * * *